US009943113B2

(12) United States Patent
Liu

(10) Patent No.: US 9,943,113 B2
(45) Date of Patent: Apr. 17, 2018

(54) ATOMIZER FILTERING LARGE SMOKE PARTICLES AND ELECTRONIC CIGARETTE THEREOF

(71) Applicants: HUIZHOU KIMREE TECHNOLOGY CO., LTD. SHENZHEN BRANCH, Shenzhen, Guangdong (CN); KUMREE HI-TECH INC., Tortola (VG)

(72) Inventor: Qiuming Liu, Guangdong (CN)

(73) Assignee: HUIZHOU KIMREE TECHNOLOGY CO., LTD. SHENZHEN BRANCH, Shenzhen, Guangdong (CN)

( * ) Notice: Subject to any disclaimer, the term of this patent is extended or adjusted under 35 U.S.C. 154(b) by 0 days.

(21) Appl. No.: 15/316,172

(22) PCT Filed: Jun. 3, 2014

(86) PCT No.: PCT/CN2014/079089

§ 371 (c)(1),
(2) Date: Dec. 22, 2016

(87) PCT Pub. No.: WO2015/184589

PCT Pub. Date: Dec. 10, 2015

(65) Prior Publication Data

US 2017/0156401 A1 Jun. 8, 2017

(51) Int. Cl.
*A24F 47/00* (2006.01)
*H05B 1/02* (2006.01)

(52) U.S. Cl.
CPC ..... *A24F 47/008* (2013.01); *H05B 1/0244* (2013.01); *H05B 2203/021* (2013.01)

(58) Field of Classification Search
None
See application file for complete search history.

(56) References Cited

U.S. PATENT DOCUMENTS

2013/0192615 A1 8/2013 Tucker et al.
2014/0261497 A1* 9/2014 Liu ..... F16L 55/115 131/329

(Continued)

FOREIGN PATENT DOCUMENTS

CN 201479921 U 5/2010
CN 203121010 U 8/2013

(Continued)

OTHER PUBLICATIONS

International Search Report for PCT/CN2014/079089, dated Feb. 27, 2015, ISA/CN.

*Primary Examiner* — Tho D Ta
(74) *Attorney, Agent, or Firm* — U.S. Fairsky LLP; Yue Xu

(57) ABSTRACT

An atomizer and an electronic cigarette. The electronic cigarette includes an electronic cigarette body. Sequentially provided on the electronic cigarette body are a mouthpiece cover, an atomizing component, and a battery component. The mouthpiece cover covers an end surface of the atomizing component. Provided within the atomizing component are an e-liquid storage space used for storing an e-liquid, an atomizing core used for atomizing the e-liquid and electrically connected to the battery component, and a smoke channel used for discharging smoke to the mouthpiece cover and extended along the axis of the atomizing component. At least two smoke outlet gaps in communication with the smoke channel are formed on the end surface of the mouthpiece cover. The smoke outlet gaps are extended from the center of the end surface of the mouthpiece cover towards the periphery of the end surface of the mouthpiece cover.

16 Claims, 4 Drawing Sheets

(56) References Cited

U.S. PATENT DOCUMENTS

| | | | | |
|---|---|---|---|---|
| 2014/0299139 | A1* | 10/2014 | Liu | A24F 47/008 131/329 |
| 2014/0338683 | A1* | 11/2014 | Liu | A24F 47/008 131/329 |

FOREIGN PATENT DOCUMENTS

| | | | |
|---|---|---|---|
| CN | 203194540 | U | 9/2013 |
| CN | 203467667 | U | 3/2014 |
| CN | 203986137 | U | 12/2014 |

* cited by examiner

ATOMIZER FILTERING LARGE SMOKE PARTICLES AND ELECTRONIC CIGARETTE THEREOF

TECHNICAL FIELD

The present disclosure relates to the field of electronic cigarette technology, and in particular to an atomizer and an electronic cigarette which can prevent a user from smoking non-atomized e-liquid and can make the user feel more comfortable when smoking.

BACKGROUND

Electronic cigarette is a new kind of electronic product. It has the same appearance and flavor as the traditional cigarette, but is more healthy and environment-friendly comparing with the traditional cigarette. The electronic cigarette atomizes e-liquid containing nicotine and essence into particles by an atomizer for output. Tar and other harmful ingredients contained in the traditional cigarette are not contained in the electronic cigarette, and second-hand smoking will not be produced.

The electronic cigarette in the prior art usually includes an atomizing assembly configured to atomizing e-liquid and a battery assembly configured to supply power to the atomizing assembly. The atomizing assembly and the battery assembly are positioned coaxially and connected to each other. A e-liquid storage sleeve configured to store the e-liquid is provided at the end of the atomizing assembly having an atomizing device. The atomizing device includes a heating wire configured to atomizing e-liquid. The end of the e-liquid storage sleeve which is away from the atomizing assembly is an open end, a suction nozzle is connected to the open end for a user to smoke, a smoke vent, which is in the same line as the smoke channel in the e-liquid storage sleeve and serves as a smoke channel, is provided in the center of the suction nozzle. The diameter of the smoke vent is usually set as 2 mm to 3 mm for smooth smoking. In the prior art, the e-liquid storage sleeve stores e-liquid, and is connected to the atomizing assembly, so as to make the heating wire of the atomizing assembly atomize the e-liquid in the e-liquid storage sleeve. The smoke formed by atomized e-liquid enters into the mouth of a smoker through the smoke channels in the e-liquid storage sleeve and the suction nozzle.

However, in the electronic cigarette described above, the smoke vent in the suction nozzle served as the smoke channel is in the same line as the smoke channel in the e-liquid storage sleeve. In the process of smoking, part of the smoke in the smoke channel of the atomizing assembly condenses into large-grained e-liquid and enters the mouth of the user with an air flow through the smoke vent, so that the user smoke the tobacco tar. In addition, in a case that the smoke emits directly from a large smoke vent, the speed of the smoke air flow is fast enough to form a torrent smoke column, which directly impinges the mouth wall of the smoker, so that the smoker usually feels discomfortable, and the user experience is poor.

SUMMARY

The present disclosure provides an atomizer and an electronic cigarette which can prevent a user from smoking non-atomized e-liquid, and make the user feel comfortable when smoking.

The present disclosure provides an electronic cigarette, includes:

an electronic cigarette body; and a suction nozzle cover, an atomizing assembly and a battery assembly configured to power the atomizing assembly sequentially provided on the electronic cigarette body.

The suction nozzle cover is provided on one end surface of the atomizing assembly.

An e-liquid storage space configured to store e-liquid, an atomizing core which is configured to atomize the e-liquid and is electrically connected to the battery assembly, and a smoke channel which is configured to emit smoke to the suction nozzle cover and extends along the axis of the atomizing assembly are provided within the atomizing assembly.

At least two smoke outlet gaps interconnected to the smoke channel are formed on the end surface of the suction nozzle cover, the two smoke outlet gaps extends from a center of the end surface of the suction nozzle cover to peripheries of the end surface of the suction nozzle cover, and the center of the end surface of the suction nozzle cover is located on the axis of the atomizing assembly.

In the electronic cigarette, width of the smoke outlet gaps is less than or equal to 0.7 mm.

In the electronic cigarette, the smoke outlet gaps have a shape of a straight line or an arc.

In the electronic cigarette, the cross-sectional area of the smoke outlet gaps, which is perpendicular to the end surface of the suction nozzle cover, gradually increases from the center of the end surface of the suction nozzle cover to the peripheries of the end surface of the suction nozzle cover.

In the electronic cigarette, an elastic layer is provided on a side wall of the suction nozzle cover conterminous to the atomizing assembly.

In the electronic cigarette, a circular truncated cone or a circular cone is provided on one side of the end surface of the suction nozzle cover facing the atomization assembly, a center axis of the circular truncated cone or the circular cone passes through the center of the end surface of the suction nozzle cover, an upper surface of the circular truncated cone or an apex of the circular cone faces the atomizing assembly, and a lower surface of the circular truncated cone or the circular cone covers parts of each of the smoke outlet gaps.

At least two through-holes are provided between a side face of the circular truncated cone or of the circular cone and each of the smoke outlet gaps, the through-holes of the circular truncated cone or of the circular cone correspond one-to-one to the smoke outlet gaps, and the through-holes are configured to connect the smoke channel to the corresponding smoke outlet gaps.

In the electronic cigarette, the atomizing assembly further includes:

an atomizing sleeve; and a tubular support frame provided in the atomizing sleeve.

The e-liquid storage space encircles a side wall of the support frame, a supported hole is provided on the side wall of the support frame, and the direction of the support hole is perpendicular to that of the support frame.

The atomizing core passes through the support hole and is fixed in the support frame, and two ends of the atomizing core are further inserted into the e-liquid storage space, so as to atomize the e-liquid in the e-liquid storage space.

The smoke channel extends along the empty center of the support frame from the atomizing core to the suction nozzle cover.

In the electronic cigarette, a circular seal ring is provided at one end of the support frame facing the suction nozzle cover, so as to seal the e-liquid storage space between the support frame and the atomizing sleeve.

The smoke channel in the support frame is interconnected to the suction nozzle cover via the through-hole of the seal ring.

In the electronic cigarette, an inner side of the seal ring is funnel-shaped, and an area of opening of the seal ring at the side facing the suction nozzle cover is larger than that facing the atomizing assembly.

In the electronic cigarette, the battery assembly includes:

a battery sleeve;

a battery provided in the battery sleeve;

a sensing assembly configured to generating a trigger signal; and a microcontroller electrically connected to the sensing assembly.

The present disclosure further discloses an atomizer. The atomizer is configured to form an electronic cigarette in conjunction with a battery assembly. A suction nozzle cover and an atomizing assembly are sequentially provided on the atomizer, and the suction nozzle cover is provided on one end of the atomizing assembly.

A e-liquid storage space configured to store the e-liquid, an atomizing core which is configured to atomize the e-liquid and is electrically connected to the battery assembly, and a smoke channel which is configured to emit smoke to the suction nozzle cover and extends along the axis of the atomizing assembly are provided in the atomizing assembly.

At least two smoke outlet gaps interconnected to the smoke channel are formed on the end surface of the suction nozzle cover, the two smoke outlet gaps extend from a center of the end surface of the suction nozzle cover to peripheries of the end surface of the suction nozzle cover, and the center of the end surface of the suction nozzle cover is located on the axis of the atomizing assembly.

In the atomizer, an elastic layer is provided on the side wall of the suction nozzle cover connected to the atomizing assembly.

In the atomizer, a circular truncated cone or a circular cone is provided at the side of the end surface of the suction nozzle cover facing the atomization assembly, the center axis of the circular truncated cone or of the circular cone passes through the center of the end surface of the suction nozzle cover, an upper surface of the circular truncated cone or an apex of the circular cone faces the atomizing assembly, and a lower surface of the circular truncated cone or of the circular cone covers parts of each of the smoke outlet gaps.

At least two through-holes are provided between a side face of the circular truncated cone or of the circular cone and each of the smoke outlet gaps, the through-holes of the circular truncated cone or of the circular cone correspond one-to-one to the smoke outlet gaps, and the through-holes are configured to connect the smoke channel to the corresponding smoke outlet gaps.

In the atomizer, the atomizing assembly further includes:

an atomizing sleeve; and a tubular support frame provided in the atomizing sleeve.

The e-liquid storage space encircles a side wall of the support frame, a supported hole is provided on the side wall of the support frame, and the direction of the support hole is perpendicular to that of the support frame.

The atomizing core passes through the support hole and is fixed in the support frame, and two ends of the atomizing core are further inserted into the e-liquid storage space, so as to atomize the e-liquid in the e-liquid storage.

The smoke channel extends along the empty center of the support frame from the atomizing core to the suction nozzle cover.

In the atomizer, a circular seal ring is provided at one end of the support frame facing the suction nozzle, so as to seal the e-liquid storage space between the support frame and the atomizing sleeve.

The smoke channel in the support frame is interconnected to the suction nozzle cover via the through-holes of the seal ring.

In the atomizer, an inner side of the seal ring is funnel-shaped, and an area of opening of the seal ring at the side facing the suction nozzle cover is larger than that facing the atomizing assembly.

As can be seen from the above technical solution, embodiments according to the present disclosure have the following advantages.

In the electronic cigarette and atomizer of the present disclosure, at least two smoke outlet gaps are provided on the end surface of the suction nozzle cover, so that the force generated when the user smokes is dispersed onto the smoke outlet gaps. Since the area of each of the smoke outlet gaps is small, the speed of the air flow generated in the smoke channel when the user smokes can be reduced, and the force applied on the condensed e-liquid in the smoke channel is effectively reduced. A part of the condensed e-liquid directly adheres to the inner wall of the smoke channel to avoid emitting, and large-grained smoke is further filtered via the smoke outlet gaps when the smoke emits from the smoke outlet gaps. The probability of taking in condensed e-liquid or large-grained smoke by the user is reduced, thereby enhancing user experience of the electronic cigarette. In addition, since the smoke outlet gaps extend from the center of the end surface of the suction nozzle cover to the peripheries of the end surface of the suction nozzle cover, the smoke emits from the center to the periphery of the suction nozzle cover. The smoke is decentralized, and emits mildly, so that the smoke is similar to the tobacco smoke. The feel of the smoking is comfortable, the situation that the torrent smoke impinges the mouth of the smoker in the prior art is avoided, and the user experience is further improved.

DETAILED DESCRIPTION OF THE EMBODIMENTS

The present disclosure discloses an atomizer and an electronic cigarette which can prevent users from smoking the non-atomized e-liquid and can make the user feel more comfortable when smoking.

The technical solutions in the embodiments of the present application will be described clearly and completely hereinafter in conjunction with the drawings in the embodiments of the present disclosure. Apparently, the described embodiments are only a part of rather than all of the embodiments of the present disclosure. Other embodiments obtained by those skilled in the art based on these embodiments of the disclosure without creative work fall within the protection scope of the disclosure.

Figure 1:
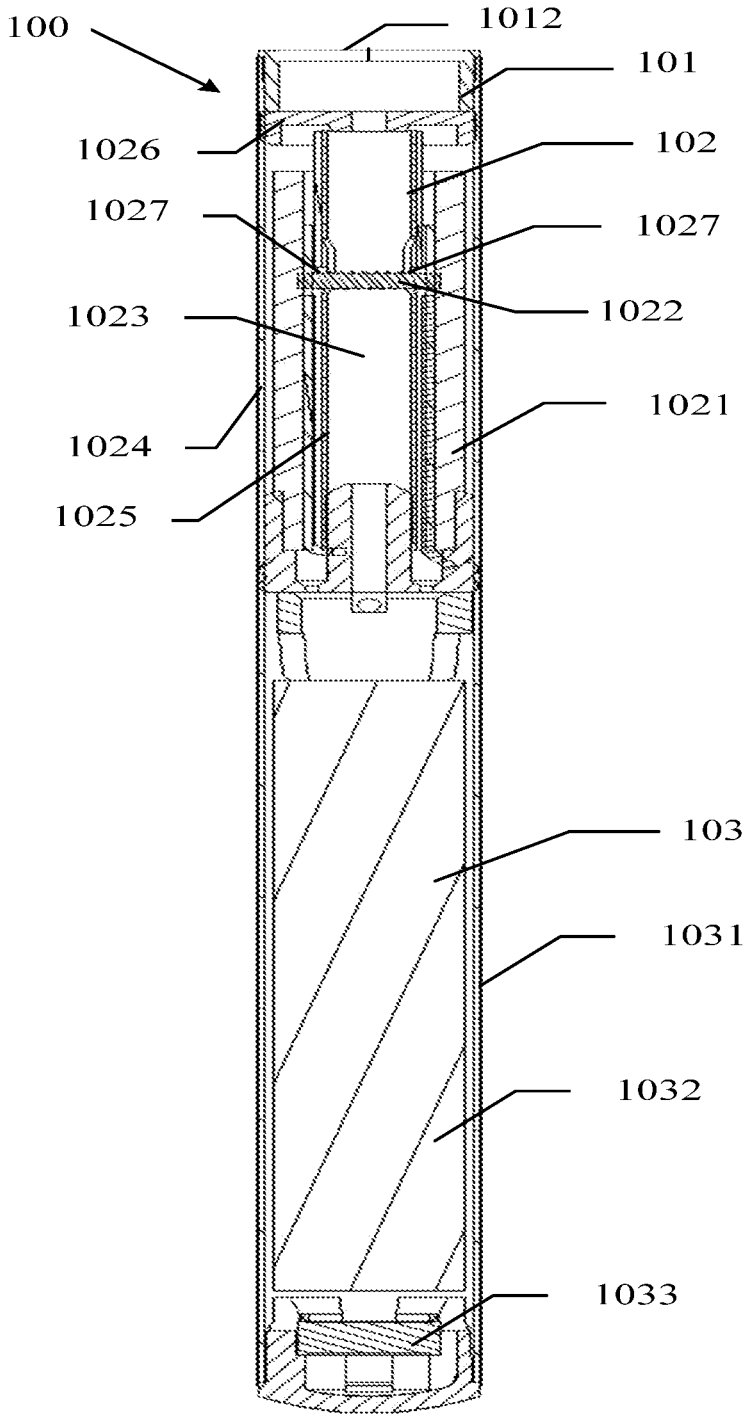
FIG. 1 is a section view of the structure of an electronic cigarette according to an embodiment of the present disclosure.

Referring to FIG. 1, an electronic cigarette according to an embodiment of the present disclosure includes the following.

In this embodiment, an electronic cigarette 100 includes:

an electronic cigarette body, sequentially provided with a suction nozzle cover 101, an atomizing assembly 102 and a battery assembly 103 configured to power the atomizing assembly 102.

Inside the atomizing assembly 102, there are provided with an e-liquid storage space 1021 configured to store e-liquid, an atomizing core 1022 which is configured to atomize the e-liquid and is connected to the e-liquid storage space 1021 and electrically connected to the battery assembly 103. Specifically, e-liquid storage cotton is provided in the e-liquid storage space 1021. In the actual implementation, other e-liquid mediums or no e-liquid medium may be provided in the e-liquid storage space, which is not limited herein. In this embodiment, the atomizing core 1022 is specifically a heating wire assembly. In the actual implementation, the atomizing core can also be achieved in another way, such as a heating band or an ultrasonic atomizing assembly, which is not limited herein. In the atomizing assembly 102, a smoke channel 1023 configured to emit the smoke to the suction nozzle cover 101 is further provided. The smoke channel 1023 is configured to connect the atomizing core 1022 to the suction nozzle cover 101, and extends along the axis of atomizing assembly 102.

Figure 2:
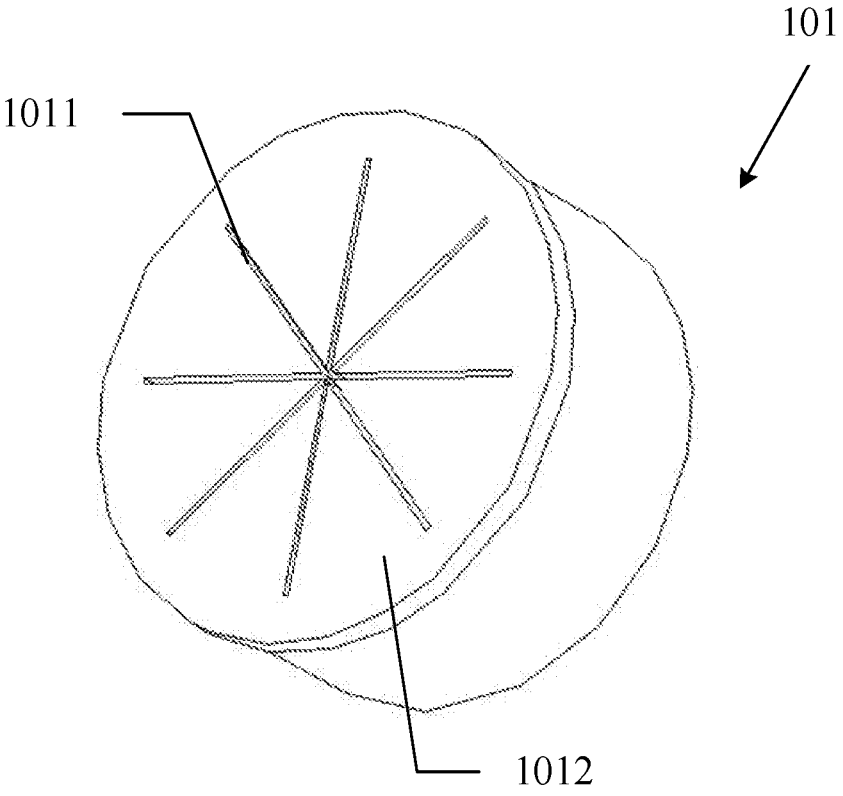
FIG. 2 is a structural diagram of a suction nozzle cover of an electronic cigarette according to an embodiment of the present disclosure.

Referring to FIG. 2, a structural diagram of a suction nozzle cover of an electronic cigarette according to an embodiment of the present disclosure is shown. At least two smoke outlet gaps 1011 interconnected to the smoke channel 1023 are provided on the end surface 1012 of the suction nozzle cover 101. The smoke outlet gaps 1011 extend from the center of the end surface 1012 of the suction nozzle cover 101 to the periphery of the end surface 1012 of the suction nozzle cover 101, and the center of the end surface 1012 of the suction nozzle cover 101 is located on the axis of the atomizing assembly 102.

The suction nozzle cover 101 covers an end surface of the atomizing assembly 102. When the user smokes, the e-liquid atomized by the atomizing core 1022 is delivered to suction nozzle cover 101 with air flow through the smoke channel 1023, and is delivered to the mouth of the user via the smoke outlet gaps 1011. In the prior art, part of the smoke condenses inside the smoke channel 1023, and in a case that large air flow is generated by the smoking of the user, the condensed e-liquid will fly to the suction nozzle cover 101 in a straight line along the smoke channel 1023 at the force of the air flow, so that the user smokes the non-atomized e-liquid.

In the present embodiment, at least two smoke outlet gaps 1011 are provided on the end surface of the suction nozzle cover 101, so that the force generated when the user smokes is dispersed onto the smoke outlet gaps 1011. Since the area of each of the smoke outlet gaps 1011 is small, the speed of the air flow generated in the smoke channel when the user smokes can be reduced, and the force applied on the condensed e-liquid in the smoke channel is effectively reduced. A part of the condensed e-liquid directly adheres to the inner wall of the smoke channel 1023 to avoid emitting, and large-grained smoke is further filtered via the smoke outlet gaps 1011 when the smoke emits from the smoke outlet gaps 1011. The probability of taking in condensed e-liquid or large-grained smoke by the user is reduced, thereby enhancing user experience of the electronic cigarette. In addition, since the smoke outlet gaps 1011 extend from the center of the end surface of the suction nozzle cover 101 to the peripheries of the end surface of the suction nozzle cover 101, the smoke emits from the center to the periphery of the suction nozzle cover 101. The smoke is decentralized, and emits mildly, so that the smoke is similar to the tobacco smoke. The feel of the smoking is comfortable, the situation that the torrent smoke impinges the mouth of the smoker in the prior art is avoided, and the user experience is further improved.

In this embodiment, since the condensed e-liquid is drop-shaped, the volume is large. Thus, in this embodiment, the width of the arc smoke outlet gaps 1011 of the suction nozzle cover 101 is, preferably, less than or equal to 0.7 mm, and more preferably, 0.3 mm. In this manner, in a case that a small part of e-liquid flies to the smoke outlet gaps 1011 at the force of the air flow, it cannot enter the mouth of the user because of the restriction of area of the smoke outlet gaps 1011, and then flows back to the smoke channel 1023 under gravity, or the user can toss the e-liquid out from the smoke outlet gaps 1011.

In the present embodiment, preferably, an elastic layer is provided on the side wall of the suction nozzle cover 101 conterminous to the atomizing assembly 102 (not shown in the drawings). The joint sealing between the suction nozzle cover and atomizing assembly may be achieved, and the leakage of the e-liquid from the joint of the suction nozzle cover and the atomizing assembly is avoided.

The smoke outlet gaps 1011 may be arranged on the suction nozzle cover 101 in multiple ways. Specifically, in the embodiment shown in FIG. 2, the suction nozzle cover 101 is a hollow tube. The end of the suction nozzle cover 101 facing the atomizing assembly 102 is completely open, and is connected to the atomizing assembly 102. The end of the suction nozzle cover 101 back to the atomizing assembly 102 is provided with the end surface 1012, and the smoke outlet gaps 1011 are provided on the end surface 1012. In this embodiment, eight smoke outlet gaps 1011 are provided on the suction nozzle cover 101, which are in a shape of "Union jack" on the end surface 1012 of the suction nozzle cover 101. In the actual implementation, the smoke outlet gaps 1011 provided on the suction nozzle cover 101 may be of other numbers, and may be arranged in other shapes on the end surface 1012, which are not limited herein. In this embodiment, each of the smoke outlet gaps 1011 on the end surface 1012 of the suction nozzle cover 101 is in a shape of a straight line. In the actual implementation, each of the smoke outlet gaps 1011 may be in other shapes.

Figure 3:
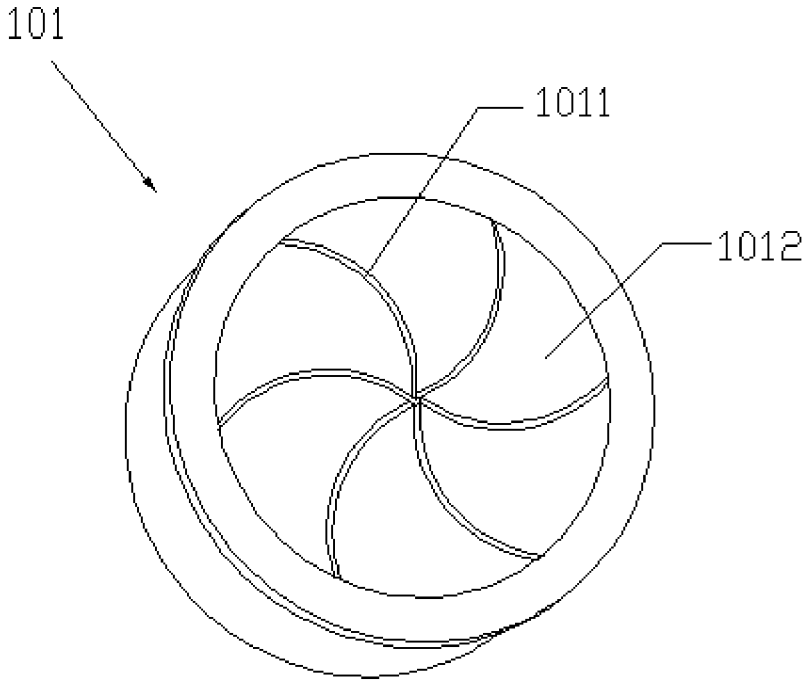
FIG. 3 is a structural diagram of a suction nozzle cover of an electronic cigarette according to another embodiment of the present disclosure.

Referring to FIG. 3, a structural diagram of a suction nozzle cover 101 of an electronic cigarette according to another embodiment of the present disclosure is shown. In this embodiment, the smoke outlet gaps 1011 are different from those shown in FIG. 2 in that the shapes are arc.

It should be noted that, each of the smoke outlet gaps 1011 may be in regular circular arc shape, or in other arc shapes, which is not limited herein. Even more, the periphery of each of the smoke outlet gaps may be an arc-like line consisting of multiple straight line segments rather than an arc.

In this embodiment, the arc-shaped smoke outlet gaps can better prevent non-atomized e-liquid from entering into the mouth of the user. Since the smoke channel extends along the axis of the atomizing assembly, and the center of the end surface of the suction nozzle cover is located on the axis of the atomizing assembly, in a case that non-atomized e-liquid flies with the air flow to the suction nozzle cover 101, the e-liquid will adhere to the center of the end surface of the suction nozzle cover, and move along the smoke outlet gaps under the force of the air flow. In this embodiment, since each of the smoke outlet gaps 1011 are in an arc shape, the e-liquid will move in a straight line from the center of the end surface of the suction nozzle cover 101 to the periphery of the end surface of the suction nozzle cover due to inertia, so that the e-liquid will gradually deviate from the smoke outlet gaps in the process of moving, thereby avoiding that the e-liquid enters the mouth of the user through the smoke outlet gaps.

Figure 4:
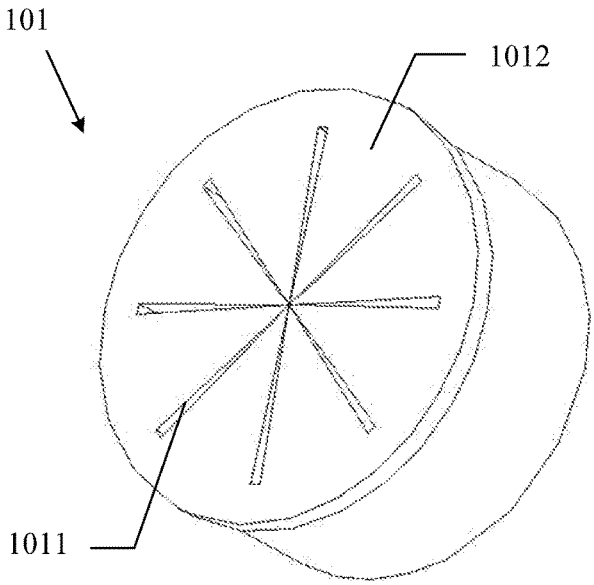
FIG. 4 is a structural diagram of a suction nozzle cover of an electronic cigarette according to another embodiment of the present disclosure.

Referring to FIG. 4, a structural diagram of a suction nozzle cover 101 of an electronic cigarette according to another embodiment of the present disclosure is shown. In this embodiment, the suction nozzle cover 101 is different from that shown in FIG. 2 in that, the cross-sectional area of the smoke outlet gaps 1011, which is perpendicular to the end surface 1012 of the suction nozzle cover 101, gradually increases from the center of the end surface 1012 of the suction nozzle cover 101 to the periphery of the end surface 1012 of the suction nozzle cover 101.

Specifically, in this embodiment, the shape of the opening of the smoke outlet gaps 1011 on the end surface 1012 of the suction nozzle cover 101 is a triangle with the center of the end surface 1012 as an apex angle. In the actual implementation, the smoke outlet gaps 1011 may be in other shapes, for example, a sector with the center of the end surface 1012 as a vertex. The above is exemplary description of shapes of the smoke outlet gaps, and is not a limit.

In this embodiment, since the cross-sectional area of the smoke outlet gaps, which is perpendicular to the end surface 1012, gradually increases from the center to the periphery of the end surface 1012, the amount of smoke which the smoker smokes may be increased in one aspect, and the probability that the non-atomized e-liquid enters into the mouth of the user via the center of the end surface 1012 may be reduced in another aspect.

Figure 5:
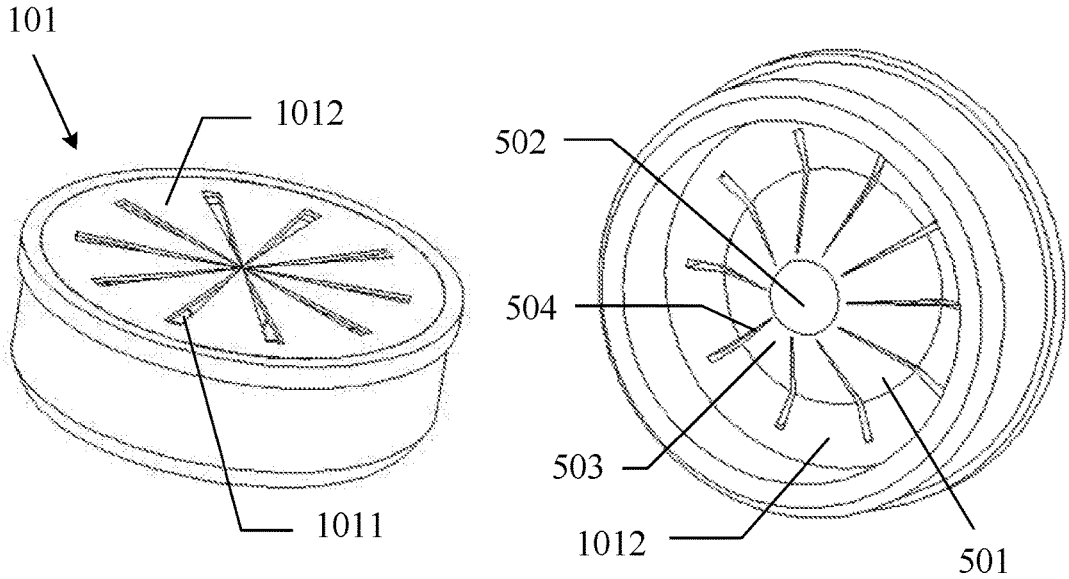
FIG. 5 is structural diagrams of a suction nozzle cover of an electronic cigarette from two angles of view according to another embodiment of the present disclosure.

Referring to FIG. 5, structural diagrams of a suction nozzle cover of an electronic cigarette from two angles of view according to another embodiment of the present disclosure are shown, In this embodiment, the suction nozzle cover is different from that shown in FIG. 4 in that, a circular truncated cone 501 is provided on the end surface 1012 of the suction nozzle cover 101 on the side facing the atomizing assembly 102, the circular truncated cone 501 includes a upper surface 502 and a lower surface which parallel to each other, and the upper surface 502 is smaller than the lower surface.

The center axis of the circular truncated cone 501 passes through the center of the end surface 1012, the upper surface 502 of the circular truncated cone 502 faces the atomizing assembly 102, and the lower surface of the circular truncated cone 501 covers at least parts of the smoke outlet gaps. Specifically, in this embodiment, the lower surface of the circular truncated cone 501 covers two thirds of the smoke outlet gaps on the end surface 1012. The above description is only for illustration, and is not a limit.

At least two through-holes 504 are provided between the side 503 of the circular truncated cone 501 and each of the smoke outlet gaps on the end surface 1012, the through-holes 504 on the side 503 of the circular truncated cone 501 and the smoke outlet gaps on the end surface 1012 are in one-to-one correspondence, and the through-holes 504 are configured to connect the smoke channel to the corresponding smoke outlet gaps.

In this embodiment, the circular truncated cone 501 is arranged such that the upper surface of the circular truncated cone 501 is located in the center area of the end surface 1012, the through-holes 504 of the circular truncated cone 501 are provided between the side face of the circular truncated cone 501 and each of the smoke outlet gaps 1011, and there is no through-hole 504 between the upper surface of the circular truncated cone 501 and the smoke outlet gaps 1011 on the end surface of the suction nozzle cover. In this manner, the non-atomized e-liquid will hit the upper surface of the circular truncated cone 501 when flying to the center of the end surface 1012 under the force of the air flow, and cannot enter the smoke outlet gaps 1011, thereby preventing the user from smoking the non-atomized e-liquid. And even if some e-liquid adheres on the side face of the circular truncated cone 501, since the upper surface of the circular truncated cone 501 faces the atomizing assembly and the upper surface is smaller than the lower surface, the side face of the circular truncated cone 501 is advantageous for the e-liquid to drop back to the smoke channel under gravity, thereby avoiding that the e-liquid enters the through-holes 504 on the side face of the circular truncated cone 501 under the force of the air flow when adhering to the side face of the circular truncated cone 501.

In the actual implementation, the circular truncated cone 501 according to this embodiment may be replaced with a circular cone. Correspondingly, the center axis of the circular cone passes through the center of the end surface, the apex of the circular cone faces the atomizing assembly, and the lower surface of the circular cone covers at least parts of each of the smoke outlet gaps 1011. The through-holes 504 are provided on the side of the circular cone, and correspond one-to-one to the smoke outlet gaps.

In the present disclosure, the atomizing assembly 102 in the electronic cigarette body may be implemented with a variety of structure. A specific structure of the atomizing assembly of the electronic cigarette is described in detail in conjunction with FIG. 1 hereinafter. Referring to FIG. 1, the atomizing assembly 102 further includes an atomizing sleeve 1024. A tubular support frame 1025 is provided in the atomizing sleeve 1024. Specifically, the support frame 1025 is a fiberglass pipe. In the actual implementation, the support frame 1025 may be made of other materials, which is not limited herein.

An e-liquid storage space 1021 encircles the outside wall of the support frame 1025, supported holes 1027 are provided on the side wall of the support frame 1025, and the direction of the support holes 1027 is perpendicular to that of the support frame 1025. An atomizing core 1022 passes through the support holes 1027, and is fixed inside the support frame 1025. Two ends of the atomizing core 1022 are inserted into the e-liquid storage space 1021, so as to atomize the e-liquid in the e-liquid storage 1021. A smoke channel 1023 extends along the empty center of the support frame 1025 from the atomizing core 1022 to the suction nozzle cover 101.

Preferably, a circular seal ring 1026 is provided at the end of the support frame 1025 facing the suction nozzle cover 101, so as to seal the e-liquid storage space 1021 between the support frame 1025 and the atomizing sleeve 1024. The smoke channel in the support frame 1025 is interconnected to the suction nozzle cover 101 via the through-hole in the center of the seal ring 1026, such that the atomized e-liquid enters into the suction nozzle cover 101 through the through-hole in the center of the seal ring 1026. In this embodiment, by providing the seal ring, the e-liquid in the e-liquid storage space 1021 can be prevented from flowing to the suction nozzle cover 101.

Since parts of atomized e-liquid flies to the suction nozzle cover 101 under the force of the air flow and adheres to the inner wall of the suction nozzle cover 101. Under gravity, the e-liquid will slowly flow to the atomizing assembly and accumulate on the side of the seal ring 1026 facing the suction nozzle cover 101. Therefore, preferably, an inner side of the seal ring 1026 is funnel-shaped, and the area of opening of the seal ring 1026 at the side facing the suction nozzle cover 101 is larger than that facing the atomizing assembly. In this manner, the e-liquid accumulated on the side of the seal ring 1026 facing the suction nozzle cover 101 will gradually flow to the center of the seal ring 1026 along the inner side of the seal ring 1026, and flow back to the smoke channel 1023 in the atomizing assembly 102 through the through-hole in the center of the seal ring 1026, avoiding being taken in by the user.

In the present disclosure, the battery assembly 103 in the electronic cigarette body may be implemented with a variety of structure. A specific structure of the battery assembly of the electronic cigarette is described in detail in conjunction with FIG. 1 hereinafter. Referring to FIG. 1, the battery assembly includes:

a battery sleeve 1031;

a battery 1032 provided in the battery sleeve 1031;

a sensing assembly 1033 configured to generate a trigger signal; and a microcontroller electrically connected to the sensing assembly (not shown in the drawings).

As shown in FIG. 1, in this embodiment, the sensing assembly preferably is implemented with an air flow sensing switch. The intensity of pressure in the electronic cigarette decreases when a user smokes through the suction nozzle cover 101. The air flow sensing switch 1033 generates a trigger signal after detecting the decrease of the intensity of pressure.

The microcontroller controls the battery 1032 of the battery assembly 103 to power the electronic cigarette after detecting the trigger signal, so as to enable the atomizing core 1022 of the electronic cigarette to atomize the e-liquid to form the smoke for the user.

Certainly, the arrangement of the sensing assembly is not limited to that shown in FIG. 1. For example, an operation button can be provided on the surface of the electronic cigarette, the user presses the operation button if he wants to smoke, and the operation button generates the trigger signal based on the operation of the user. The microcontroller controls the battery 1032 of the battery assembly 103 to power the electronic cigarette after detecting the trigger signal, so as to enable the atomizing core 1022 of the electronic cigarette to atomize the e-liquid to form the smoke for the user.

The present disclosure further discloses an atomizer, which is configured to form an electronic cigarette in conjunction with a battery assembly. A suction nozzle cover and an atomizing assembly are provided on the atomizer, and the suction nozzle cover is provided on an end surface of the atomizing assembly. In this embodiment, a connector detachably connected to the battery assembly is provided at one end of the atomizer away from the suction nozzle cover, which is the prior art and is not described herein. In addition, in the atomizer according to the present embodiment, the structure of the suction nozzle cover and atomizing assembly is the same as that described above, which is not described herein.

The above embodiments are described in a progressive manner. Each of the embodiments focuses on differences from other embodiments, and references may be made to each other with respect to the same or similar portions among these embodiments.

The above description of the embodiments enables those skilled in the art to implement or use the present disclosure. Various modifications to these embodiments are apparent to those skilled in the art, and the general principle defined herein may be implemented in other embodiments without deviating from the spirit or scope of the present disclosure. Therefore, the present disclosure is not limited to these embodiments described herein, but in accordance with the widest scope consistent with the principle and novel features disclosed herein.

The invention claimed is:

1. An electronic cigarette, comprising:

an electronic cigarette body; and a suction nozzle cover, an atomizing assembly and a battery assembly configured to power the atomizing assembly sequentially provided on the electronic cigarette body, wherein the suction nozzle cover is provided on one end surface of the atomizing assembly;

an e-liquid storage space configured to store e-liquid, an atomizing core which is configured to atomize the e-liquid and is electrically connected to the battery assembly, and a smoke channel which is configured to emit smoke to the suction nozzle cover and extends along the axis of the atomizing assembly are provided within the atomizing assembly; and at least two smoke outlet gaps interconnected to the smoke channel are formed on an end surface of the suction nozzle cover, the two smoke outlet gaps extends from a center of the end surface of the suction nozzle cover to peripheries of the end surface of the suction nozzle cover, and the center of the end surface of the suction nozzle cover is located on the axis of the atomizing assembly, wherein a circular truncated cone or a circular cone is provided on one side of the end surface of the suction nozzle cover facing the atomization assembly, a center axis of the circular truncated cone or the circular cone passes through the center of the end surface of the suction nozzle cover, an upper surface of the circular truncated cone or an apex of the circular cone faces the atomizing assembly, and a lower surface of the circular truncated cone or the circular cone covers parts of each of the smoke outlet gaps; and at least two though-holes are provided between a side face of the circular truncated cone or of the circular cone and each of the smoke outlet gaps, the through-holes of the circular truncated cone or of the circular cone correspond one-to-one to the smoke outlet gaps, and the though-holes are configured to connect the smoke channel to the corresponding smoke outlet gaps.

2. The electronic cigarette according to claim 1, wherein a cross-sectional area of the smoke outlet gaps, which is perpendicular to the end surface of the suction nozzle cover, gradually increases from the center of the end surface of the suction nozzle cover to the peripheries of the end surface of the suction nozzle cover.

3. The electronic cigarette according to claim 1, wherein an elastic layer is provided on a side wall, which is connected to the atomizing assembly, of the suction nozzle cover.

4. The electronic cigarette according to claim 1, wherein the battery assembly comprises:

a battery sleeve;

a battery provided in the battery sleeve;

a sensing assembly configured to generate a trigger signal; and a microcontroller electrically connected to the sensing assembly.

5. The electronic cigarette according to claim 1, wherein the atomizing assembly further comprises:

an atomizing sleeve; and a tubular support frame provided in the atomizing sleeve, wherein the e-liquid storage space encircles a side wall of the support frame, a supported hole is provided on the side wall of the support frame, and the direction of the support hole is perpendicular to that of the support frame;

the atomizing core passes through the support hole and is fixed in the support frame, and two ends of the atomizing core are further inserted into the e-liquid storage space, so as to atomize the e-liquid in the e-liquid storage space; and the smoke channel extends along the empty center of the support frame from the atomizing core to the suction nozzle cover.

6. The electronic cigarette according to claim 5, wherein a circular seal ring is provided at one end of the support frame facing the suction nozzle cover, so as to seal the e-liquid storage space between the support frame and the atomizing sleeve; and the smoke channel in the support frame is interconnected to the suction nozzle cover via the through-hole of the seal ring.

7. The electronic cigarette according to claim 6, wherein an inner side of the seal ring is funnel-shaped, and an area of opening of the seal ring at the side facing the suction nozzle cover is larger than that facing the atomizing assembly.

8. The electronic cigarette according to claim 1, wherein width of the smoke outlet gaps is less than or equal to 0.7 mm.

9. The electronic cigarette according to claim 8, wherein a cross-sectional area of the smoke outlet gaps, which is perpendicular to the end surface of the suction nozzle cover, gradually increases from the center of the end surface of the suction nozzle cover to the peripheries of the end surface of the suction nozzle cover.

10. The electronic cigarette according to claim 1, wherein the smoke outlet gaps have a shape of a straight line or an arc.

11. The electronic cigarette according to claim 10, wherein a cross-sectional area of the smoke outlet gaps, which is perpendicular to the end surface of the suction nozzle cover, gradually increases from the center of the end surface of the suction nozzle cover to the peripheries of the end surface of the suction nozzle cover.

12. An atomizer, wherein the atomizer is configured to form an electronic cigarette in conjunction with a battery assembly, a suction nozzle cover and an atomizing assembly is sequentially provided on the atomizer, and the suction nozzle cover is provided on one end of the atomizing assembly;

an e-liquid storage space configured to store the e-liquid, an atomizing core which is configured to atomize the e-liquid and is electrically connected to the battery assembly, and a smoke channel which is configured to emit smoke to the suction nozzle cover and extends along the axis of the atomizing assembly are provided in the atomizing assembly; and at least two smoke outlet gaps interconnected to the smoke channel are formed on an end surface of the suction nozzle cover, the two smoke outlet gaps extend from a center of the end surface of the suction nozzle cover to peripheries of the end surface of the suction nozzle cover, and the center of the end surface of the suction nozzle cover is located on the axis of the atomizing assembly, wherein a circular truncated cone or a circular cone is provided at the side of the end surface of the suction nozzle cover facing the atomization assembly, the center axis of the circular truncated cone or of the circular cone passes through the center of the end surface of the suction nozzle cover, an upper surface of the circular truncated cone or an apex of the circular cone faces the atomizing assembly, and a lower surface of the circular truncated cone or of the circular cone covers parts of each of the smoke outlet gaps; and at least two through-holes are provided between a side face of the circular truncated cone or of the circular cone and each of the smoke outlet gaps, the through-holes of the circular truncated cone or of the circular cone correspond one-to-one to the smoke outlet gaps, and the through-holes are configured to connect the smoke channel to the corresponding smoke outlet gaps.

13. The atomizer according to claim 12, wherein an elastic layer is provided on a side wall, which is connected to the atomizing assembly, of the suction nozzle cover.

14. The atomizer according to claim 12, wherein the atomizing assembly further comprises:

an atomizing sleeve; and a tubular support frame provided in the atomizing sleeve, wherein the e-liquid storage space encircles a side wall of the support frame, a supported hole is provided on the side wall of the support frame, and the direction of the support hole is perpendicular to that of the support frame;

the atomizing core passes through the support hole and is fixed in the support frame, and two ends of the atomizing core are further inserted into the e-liquid storage space, so as to atomize the e-liquid in the e-liquid storage; and the smoke channel extends along the empty center of the support frame from the atomizing core to the suction nozzle cover.

15. The atomizer according to claim 14, wherein a circular seal ring is provided at one end of the support frame facing the suction nozzle, so as to seal the e-liquid storage space between the support frame and the atomizing sleeve; and the smoke channel in the support frame is interconnected to the suction nozzle cover via the through-holes of the seal ring.

16. The atomizer according to claim 15, wherein an inner side of the seal ring is funnel-shaped, and an area of opening of the seal ring at the side facing the suction nozzle cover is larger than that facing the atomizing assembly.

* * * * *